United States Patent [19]

Harding

[11] Patent Number: 4,761,840

[45] Date of Patent: Aug. 9, 1988

[54] PORTABLE TOILET CABANA

[75] Inventor: George W. Harding, Clearwater, Fla.

[73] Assignee: Poly-John Enterprises Corp., Whiting, Ind.

[21] Appl. No.: 110,591

[22] Filed: Oct. 20, 1987

Related U.S. Application Data

[63] Continuation of Ser. No. 810,665, Dec. 19, 1985, abandoned.

[51] Int. Cl.[4] ..... A47K 4/00

[52] U.S. Cl. ..... 4/664; 4/661; 126/433; 165/48.2

[58] Field of Search ..... 4/664, 665, 639, 642, 4/661; 126/433; 237/2 B; 323/906; 52/34; 165/48.2; 137/334

[56] References Cited

U.S. PATENT DOCUMENTS

| | | | |
|---|---|---|---|
| 2,817,091 | 12/1957 | Painter . | |
| 2,817,846 | 12/1957 | Stift . | |
| 3,005,205 | 10/1961 | Breen | 4/664 |
| 3,447,167 | 6/1969 | Harding | 52/34 |
| 3,594,825 | 7/1971 | Reid | 4/664 |
| 4,006,857 | 2/1977 | Adrian | 237/2 B |
| 4,313,424 | 2/1982 | Schreyer et al. | 126/433 |
| 4,409,961 | 10/1983 | O'Hare | 126/433 |

*Primary Examiner*—Henry J. Recla
*Assistant Examiner*—Linda J. Sholl
*Attorney, Agent, or Firm*—Cullen, Sloman, Cantor, Grauer, Scott and Rutherford

[57] ABSTRACT

In connection with a portable toilet cabana or the like, a solar powered system for regulating the temperature of a supply of clean water such that drinking temperature water and hand washing temperature water are provided.

3 Claims, 1 Drawing Sheet

PORTABLE TOILET CABANA

This is a continuation of application Ser. No. 810,665, filed on Dec. 19, 1985, now abandoned.

BACKGROUND OF THE INVENTION

This invention relates to an improved portable toilet cabana. Typically, portable toilet cabanas are used on construction sites, in connection with parades, outdoor concerts and the like, on golf courses and on farms or in connection with agricultural cultivation or harvesting. In the instances of construction sites and in connection with parades, concerts and the like, the portable toilet cabana is erected for a shorter duration than in the latter instances. In connection with golf courses or farms, the portable toilet cabanas, although "portable", are more often than not retained in essentially the same location for prolonged periods of time. On most of these occasions, cool drinking water and warm hand washing water are both desirable if not demanded by law.

Recently, a requirement has been imposed by the United States government in connection with agricultural harvesting (e.g. crop picking) wherein potable water and hand washing water must both be provided for the workers. The interim solution to this requirement has heretofore been that vehicles have been provided in the field with cold water supplies being "trucked in" on virtually a daily basis, and warm hand washing water has not been provided. Of course, this is not an acceptable solution.

Furthermore, it has long been recognized that despite the necessity of the portable toilet cabana, it would be desirable for hygienic purposes to provide at least hand washing water if not both hand washing and potable water.

The present invention, therefore, addresses these problems and provides a solution. In addition, the present invention is not restricted to portable toilet cabanas in that the principles may be applied to provide drinking water for cattle, cool water for bird baths, water for fountains, etc.

SUMMARY OF THE INVENTION

The present invention provides for cool potable and warm hand washing water in connection with a portable toilet cabana by providing both a reservoir of clean water and means for regulating the temperature of the clean water.

More particularly, it should be appreciated that drinking water should be in the range of 55 degrees Fahrenheit and washing water should be in the range of 100 degrees Fahrenheit. These ranges are given for relative comparative purposes to demonstrate that substantially different temperatures are required for the two different types of water.

Of course, portable toilet cabanas are not normally provided with electricity. According to the principles of the present invention, solar energy is utilized to control the temperature of the water including operating bi-directional heat transfer units, which heat and/or cool the water temperature as necessary. Preferably, these are two solid state heat transfer devices such as heat pumps. Solar energy is provided to charge rechargeable batteries, as will be explained in greater detail.

It should be further appreciated, as will be understood in greater detail upon reading the following detailed description of the invention, that the electrical demands, heating demands and cooling demands are intermittent and therefore the low voltage requirements can be met through the use of solar energy and solid state electronics.

The present invention further contemplates other uses for the solar generated electricity for the portable toilet cabana. For example, the electronic system permits a conventional fan, which may be part of the heat transfer unit, to serve the additional function of a ventilation fan even if the heat transfer unit is off.

BRIEF DESCRIPTION OF THE DRAWINGS

The foregoing advantages, features and benefits of the present invention, together with other advantages which may be attained by its use, will become more apparent upon reading the following detailed description of the invention taken in conjunction with the drawings.

In the drawings, wherein like reference numerals identify corresponding components.

DETAILED DESCRIPTION OF THE INVENTION

Figure 1:
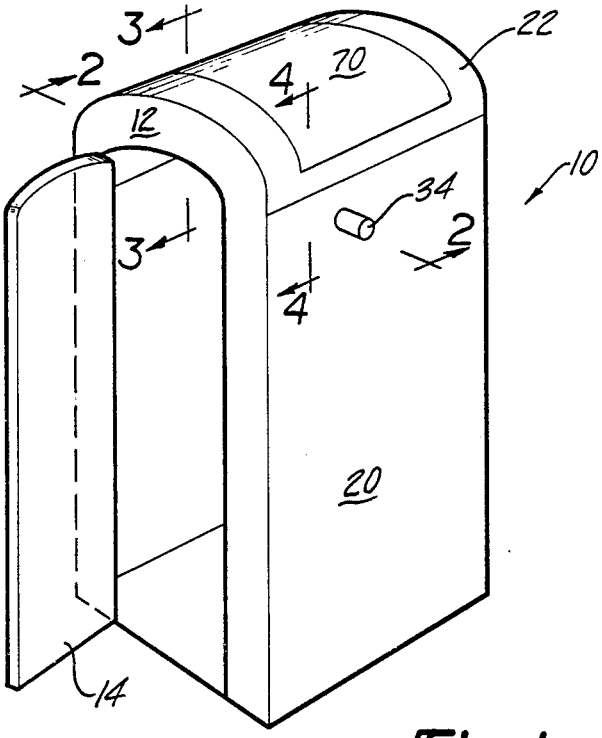
FIG. 1 is a perspective diagrammatic illustration of a portable toilet cabana according to the principles of the present invention.

With reference to the drawings, the present invention will now be explained in the context of a conventional portable toilet cabana 10. The portable toilet cabana is a generally rectangular, round, or semi-round cabana. For convenience, there is illustrated a square cabana which is nominally four foot wide by four foot deep by about seven feet high and includes a front wall 12, having an access door 14, a rear wall 16, side walls 18 and 20 forming the cabana, with the cabana enclosed by a roof 22 which may be slanted or domed.

Figure 2:
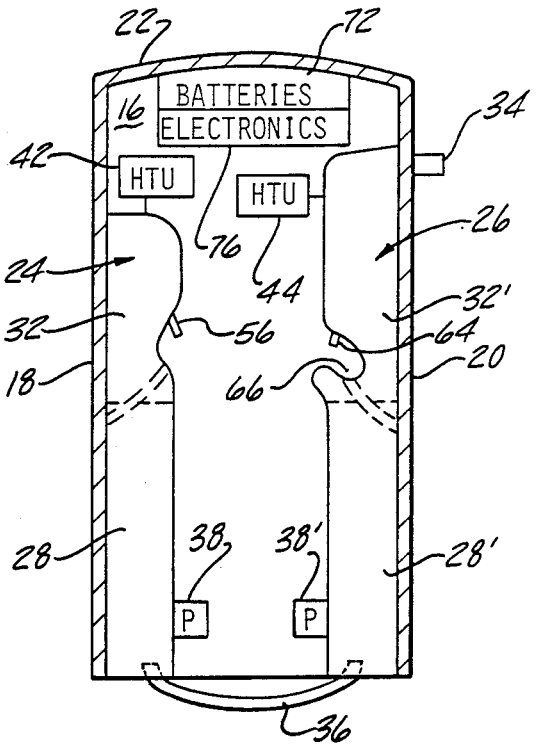
FIG. 2 is a diagrammatic illustration, partly in section, of a portable toilet cabana according to the principles of the present invention seen generally in the direction of arrows 2—2 of FIG. 1.
Figure 3:
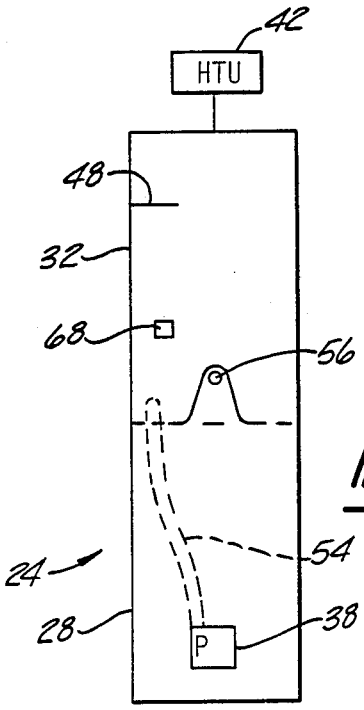
FIG. 3 is an illustration of one portion of the system as generally seen in the plane of arrows 3—3 such as, for example, the provision of drinking water.
Figure 4:
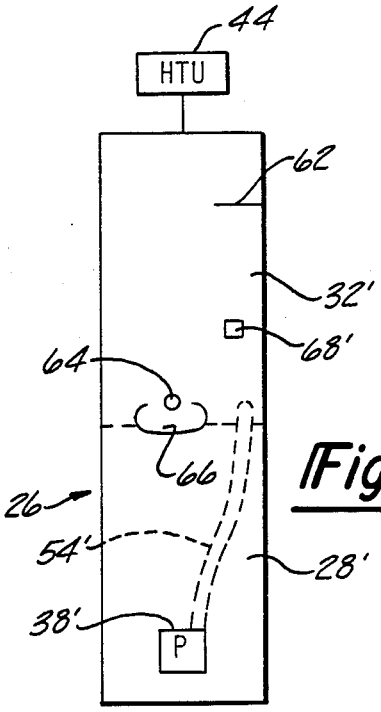
FIG. 4 is an illustration, generally in the direction of arrows 4—4 of FIG. 1, showing a portion of the invention for the provision of hand washing water.

According to the principles of the present invention, at least one reservoir is provided and means are provided for regulating the temperature of the water in the reservoir. The following may be considered as exemplary of these principles. The portable cabana may be provided with tanks 24 and 26, each of which may be molded of fiberglass, polyethylene or other material which is preferably non-thermal conductive. Two such tanks are illustrated, one in each of the front two corners of the cabana. Each tank may be thought of as comprising two vertically aligned sections, a bottom section 28, 28', respectively and an upper section 32, 32' respectively. The bottom sections may be thought of as a reservoir for storing water at ambient temperature. Specifically, when fresh water is delivered to the cabana, such as through a locked inlet port 34, the fresh water flows through a conduit, not shown, to the bottom portion of one of the tanks. A conduit 36, illustrated diagrammatically in FIG. 2 interconnects the bottom portions 28, 28' of each of the tanks 24, 26 to illustrate diagrammatically that upon filling the reservoir with fresh water, the fresh water fills both of the tanks. A locked inlet port 34 is preferred to prevent filling of the tanks improperly or with improper material. The bottom 28 of tank 24 and the bottom 28' of tank 26 together could provide a supply capacity, for example, of twenty gallons. It should be clearly understood that the capacity as described throughout this application is only for the purpose of illustration. Furthermore, should a larger capacity be desired, auxiliary tanks may be provided including auxiliary tanks exteriorly of the cabana.

Mounted near each of the tanks 24, 26 is an electrically operated pump 38, 38'. The pump is to be connected to a source of electricity by wires (not shown).

Considering now the potable water aspect of the present invention, the upper portion 32 of tank 24 could, by way of illustration only, have about a six gallon capacity and a bi-directional heat transfer unit 42 associated with the tank 24 wil maintain the water temperature in the desired range for drinking water, that is, nominally 55 degrees. The bi-directional heat transfer unit (HTU) may be thought of as a solid state heat pump. This unit functions to add heat to or remove heat from the water in the tank as desired. Electricity is provided to the heat transfer unit via electrical wires (not shown). A float device 48 is provided within the upper portion of tank 24 such that when the water level in the upper portion 32 of the tank 24 drops below the level of the float 48, demand is made to actuate the pump 38 to pump water up through a conduit 54 into the upper portion 32 of the tank. At the bottom or lower portion of the upper tank 24, there may be a conventional spigot and push button unit 56 such that upon depressing the push button, water from the upper unit flows via gravity out through the spigot 56. If desired or mandated by law, the push button and spigot unit may be on the outside of the cabana.

Reference should now briefly be had to the other or second tank 26 which includes a pump 38' near the bottom and a second bi-directional heat transfer unit within the upper portion. The upper portion 32 of the tank 26 may have a larger capacity, such as eight gallons, than the upper portion 32 of the tank associated with the drinking water. A low level float 62 is provided to cause water to be pumped via pump 38' from the lower section 28' through conduit 54', when the level drops below the float. At the bottom of the upper unit 32' there is a spigot 64 plus a sink 66.

Suitable thermostats 68, 68' are mounted within the upper portion of the tanks 24 and 26, respectively, to regulate the water temperature. The tanks may be considered as a lower reservoir means or storage means for "ambient" temperature water plus an upper reservoir means or storage means for temperature regulated water.

Means are provided, according to the principles of the present invention, for operating the heat transfer units. Specifically, solar panels or solar collectors or solid state solar plates 70 are placed on the top or roof 22 of the cabana. A conventional solar unit may be utilized which provides electricity to operate the pumps and also electricity to charge rechargeable batteries 72 such that power is available in the evening, etc.

It is an important aspect of the present invention that a small voltage, typically 12 or 24 volts, is all that is necessary to provide the desired functions. This may be accomplished by intermittent actuation of the pumps 38, 38' and intermittment heating and cooling of small amounts of water. By way of example, consider first the cool or potable water unit 24. The upper tank portion has approximately a 6.0 gallon capacity. The float 48 is positioned such that when the volume of water drops to about 5.5 gallons, an additional 0.5 gallons is pumped into the upper holding area. The ratio of 0.5/6.0 is about a 1:12 ratio and thus when ambient water is pumped into the upper portion of the tank, the small amount of water added will not greatly change the temperature of the cool water within the upper tank portion. Thus, the electrical draw or usage to run the pump and the heat transfer unit is minor and intermittent. Utilization of drinking or potable water is anticipated to be less than utilization of hand washing water.

With respect to the water in tank 26 for hand washing, when the water level drops by about one gallon, from the original approximately eight gallon capacity, the pump will be triggered to pump an additional gallon through the conduit and this being only about a 1:8 ratio to the capacity of the water in the upper portion of the tank 26, will not significantly change the temperature of the about 100 degree water already within the upper portion of the tank. Again, the electrical draw to run the pump and the heat transfer unit will be minor and intermittent.

It should be appreciated, that the capacities, temperatures and the like are representative only and should not be taken as a limitation.

In connection with disposal of waste water, the cold water from tank 24 may be drained into the holding tank of the cabana or may drain outside onto the ground. Equally, the hand washing water from tank 26 may drain outside onto the ground to the rear of the cabana, or into a holding tank.

It is within the spirit and scope of the present invention to provide ventilation by allowing the heat transfer unit fan to operate even if the heat transfer unit is off. Again, operation should be intermittent, on a timed basis, so as not to drain the batteries.

As is understood with solar collectors, when sunlight reaches the solar collectors, electricity is provided to charge the batteries (when necessary) and to operate the system. Through the use of the electronics 76, it is contemplated that various power systems may be used. For example, solar energy may charge the rechargeable batteries and only the batteries used to run the pump, heat transfer units, etc. Alternatively, via the electronics, when the batteries are fully charged the solar power may be used to run the equipment. These solar systems, although not previously used in connection with toilet cabanas, are conventional and include a control switching system or electronics to prioritize the various electrical tasks. Here, the priority use of electricity would be to charge the batteries and then fill the upper tanks, and then heat/cool the water in the upper tanks.

These principles may be applied to other devices where temperature-controlled water is desired.

The foregoing is a complete description of a preferred embodiment of the present invention. Various changes and modifications may be made without departing from the spirit and scope of the present invention. The invention, therefore, should be limited only by the following claims.

What is claimed is:

1. An improved portable toilet cabana for use in remote location, said cabana including an enclosure having four walls a top and bottom and a door in one of said four walls for entry into said enclosure and a self-contained water supply mounted within said enclosure; said improved toilet cabana comprising:

two separate reservoirs for containing said self-contained water supply said separate reservoirs supplying both hot and cold running water as needed, each of said reservoirs being an integral unit with one reservoir adapted to provide hot water and the other reservoir adapted to provide cold water;

each of said integral reservoirs being sectioned into an upper and a lower watertight compartment; said lower compartment having a larger capacity than said upper compartment for storing a supply of water therein to be supplied to said upper compartment when the level of said upper compartment is below a predetermined level, said compartments being in fluid communication with one another such that water may be delivered from said lower compartment to said upper compartment when the water level of said upper compartment reaches said predetermined level;

a valve protruding from said upper compartment for selectively releasing water from said upper compartment for use; said valve being positioned between said upper and lower compartments at the bottom of said upper compartment;

a water inlet extending through one of said walls of said cabana and interconnected to said lower compartment of one of said reservoirs;

interconnecting means for interconnecting said reservoirs so that water delivered to said lower compartment of one of said reservoirs is communicated between said reservoirs to fill both of said lower compartments of said reservoirs;

bi-directional heat transfer means operatively connected to each of said upper sections to maintain said water in said upper sections at said predetermined temperatures with the water in one of the upper sections being heated and the water in the other of the upper sections being cooled; and solar power means for providing power to said bi-directional heat transfer means.

2. The improved cabana of claim 1, wherein said fluid connecting means includes an electric pump operatively connected between said upper and lower sections such that upon depletion of water in said upper section said pump automatically activates to pump water from said lower section to said upper section, said electric pump being powered by said solar power means.

3. The improved cabana of claim 1, wherein said solar power means includes a solar collector mounted to the exterior of said cabana operatively connected to said bi-directional heat transfer means.

* * * * *